US010031477B2

(12) United States Patent
Imanari et al.

(10) Patent No.: US 10,031,477 B2
(45) Date of Patent: Jul. 24, 2018

(54) IMAGE FORMING APPARATUS

(71) Applicant: CANON KABUSHIKI KAISHA, Tokyo (JP)

(72) Inventors: Hiroshi Imanari, Yokohama (JP); Satoru Takahashi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/370,552

(22) Filed: Dec. 6, 2016

(65) Prior Publication Data

US 2017/0160699 A1 Jun. 8, 2017

(30) Foreign Application Priority Data

Dec. 8, 2015 (JP) ..... 2015-239387

(51) Int. Cl.
*G03G 21/20* (2006.01)

(52) U.S. Cl.
CPC ..... *G03G 21/206* (2013.01)

(58) Field of Classification Search
None
See application file for complete search history.

(56) References Cited

U.S. PATENT DOCUMENTS

2014/0328606 A1* 11/2014 Katsuyama ..... G03G 15/0189 399/92

FOREIGN PATENT DOCUMENTS

| | | | |
|---|---|---|---|
| JP | H1184962 | A | 3/1999 |
| JP | H1184989 | A | 3/1999 |
| JP | 2003076253 | A | 3/2003 |
| JP | 2005084155 | A | 3/2005 |
| JP | 2013088756 | A | 5/2013 |

* cited by examiner

*Primary Examiner* — Thomas Giampaolo, II
(74) *Attorney, Agent, or Firm* — Rossi, Kimms & McDowell LLP

(57) ABSTRACT

The image forming apparatus includes an open/close cover, a side cover, and a fan configured to take in ambient air through a vent hole, and generate airflow to cool an inside of the image forming apparatus, wherein the side cover includes an outside surface C, at least part of which faces the open/close cover, and a vent hole is provided in the outside surface C.

18 Claims, 7 Drawing Sheets

IMAGE FORMING APPARATUS

BACKGROUND OF THE INVENTION

Field of the Invention

The present invention relates to an image forming apparatus adapted to cool heat generating components in the image forming apparatus.

Description of the Related Art

Conventionally, as disclosed in Japanese Patent Application Laid-Open Nos. H11-084989 and 2003-076253, an image forming apparatus is provided with an air blowing unit adapted to cool heat generating components such as a process cartridge and power supply in the image forming apparatus by sending air into the image forming apparatus from outside the image forming apparatus. Such an image forming apparatus has a vent hole provided in a side face of the image forming apparatus in order for air to enter the image forming apparatus from outside the image forming apparatus. Also, a fan is provided in the neighborhood of the vent hole in the image forming apparatus to send air into the image forming apparatus from outside the image forming apparatus.

Then, the air sent into the image forming apparatus through the vent hole by the fan is guided toward heat generating components such as the process cartridge by a guide member. In this way, the heat generating components in the image forming apparatus are cooled. Here, an open/close door may be provided in a side face of the image forming apparatus to attach and detach the process cartridge to and from an apparatus body. Of the side faces of the image forming apparatus, the vent hole is often formed in a side face in which the open/close door is not provided.

However, depending on the environment in which the image forming apparatus is used, the image forming apparatus may be installed with side faces of the image forming apparatus placed in contact with walls. If the image forming apparatus is installed in such a way that the side face provided with the vent hole is placed in contact with a wall, the vent hole will be closed by the wall and volume of air entering the image forming apparatus might be reduced greatly. Consequently, the heat generating components in the image forming apparatus are not cooled sufficiently, and components of the image forming apparatus might be damaged. Also, if a convex portion is provided on the side face in which the vent hole is provided, a space can be provided between the side face and wall, but then the image forming apparatus get larger or installation space of the image forming apparatus might get larger.

SUMMARY OF THE INVENTION

It is a feature of the present invention to cool heat generating components in an image forming apparatus without increasing installation space of the image forming apparatus.

It is another feature of the present invention to provide an image forming apparatus which includes: a first cover configured to make up a first outside surface of the image forming apparatus; a second cover provided inside the image forming apparatus and configured to make up a second outside surface of the image forming apparatus different from the first outside surface, a vent hole being formed in the second cover; and a fan configured to take in ambient air through the vent hole and generate airflow to cool an inside of the image forming apparatus, wherein the second cover includes a third outside surface, at least part of which faces the first cover, and part of the vent hole is formed in the third outside surface.

Further features of the present invention will become apparent from the following description of exemplary embodiments with reference to the attached drawings.

DESCRIPTION OF THE EMBODIMENTS

Embodiment

An embodiment of the present invention will be illustrated below by way of example with reference to the drawings. However, the sizes, materials, shapes, and relative locations of the components described in the following embodiment are to be changed as required depending on the configuration and conditions of the apparatus to which the present invention is applied, and the scope of the present invention is not limited to the embodiment described below.

<Overall Schematic Configuration of Image Forming Apparatus>

Figure 1:
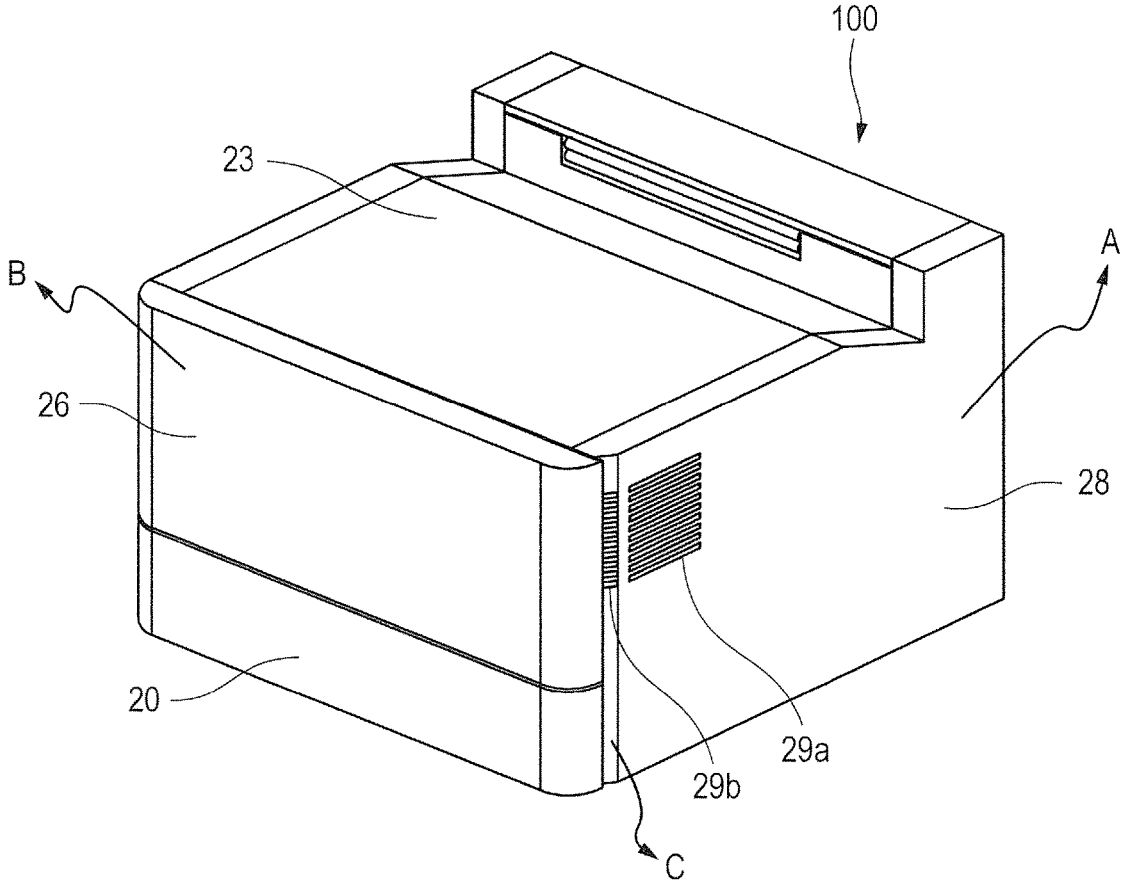
FIG. 1 is an external perspective view of an image forming apparatus according to an embodiment.
Figure 2:
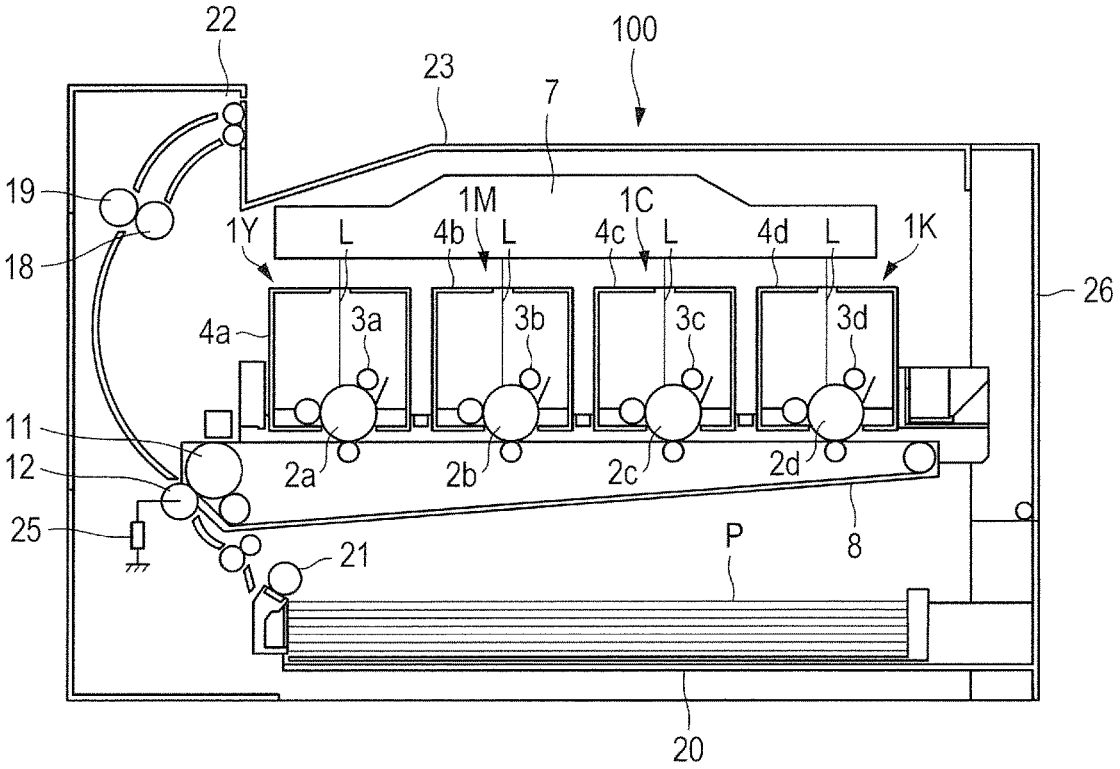
FIG. 2 is a schematic sectional view of the image forming apparatus according to the embodiment.

FIG. 1 is an external perspective view of an image forming apparatus 100 according to an embodiment. Also, FIG. 2 is a schematic sectional view of the image forming apparatus 100 according to the embodiment. In the embodiment, the image forming apparatus 100 is an electrophotographic tandem laser printer. A laser scanner 7, photosensitive drums 2*a* to 2*d*, developing devices 4*a* to 4*d*, an intermediate transfer belt 8, a fixing film 18, a pressure roller 19, a feeding tray 20 and a feeding roller 21 are installed in the image forming apparatus 100.

Paper P serving as a recording medium and loaded in the feeding tray 20 is fed by the feeding roller 21 rotating clockwise in FIG. 2 feeding tray 20 and sent to a nip portion (secondary transfer unit) between a belt driven roller 11 and a secondary transfer roller 12. The photosensitive drums 2*a* to 2*d* rotate counterclockwise in FIG. 2 and surfaces of the photosensitive drums 2*a* to 2*d* are charged uniformly by charging rollers 3*a* to 3*d* serving as charging devices. Then, electrostatic latent images are formed on outer circumferential surfaces of the photosensitive drums 2*a* to 2*d* in sequence by a laser beam L from the laser scanner 7 serving as an exposure unit. Next, the electrostatic latent images are developed by the developing devices 4*a* to 4*d* and consequently toner images are formed as developer images on the outer circumferential surfaces of the photosensitive drums 2*a* to 2*d*.

The toner images formed on the photosensitive drums 2*a* to 2*d* are transferred to the intermediate transfer belt 8. To form a color image, toner images of different colors, i.e., yellow, magenta, cyan, and black toner images, are formed on the photosensitive drums 2*a* to 2*d*. Then, the toner images formed on the respective photosensitive drums 2*a* to 2*d* are transferred on top of another in sequence to the intermediate transfer belt 8. That is, the toner images formed on the respective photosensitive drums 2*a* to 2*d* are transferred in superimposition to the intermediate transfer belt 8 by a primary transfer unit.

Next, the toner images formed on the intermediate transfer belt 8 are transferred to paper P in the nip portion between the belt driven roller 11 and secondary transfer roller 12. When a voltage is applied to the secondary transfer roller 12 from a transfer power supply 25 connected to the secondary transfer roller 12, the toner images on the intermediate transfer belt 8 are transferred to the paper P. Now, to form a color image as described above, the toner images superimposed on the intermediate transfer belt 8 are transferred in a batch to the paper P by the secondary transfer unit.

Furthermore, the paper P to which the toner images have been transferred is sent to the nip portion between the fixing film 18 and pressure roller 19 and heated and pressurized, and consequently the toner images are fixed to the paper P. The paper P with the toner images fixed thereto is ejected onto a paper output tray 23 by a paper output roller pair 22. The photosensitive drums 2*a* to 2*d* according to the present embodiment are integrated with the charging rollers 3*a* to 3*d* and developing devices 4*a* to 4*d* serving as processing units acting on the photosensitive drums 2*a* to 2*d* into process cartridge 1Y to 1K. The plural process cartridge 1Y to 1K are designed to be attachable to and detachable from the image forming apparatus 100.

<Replacement of Process Cartridges>

Figure 3A:
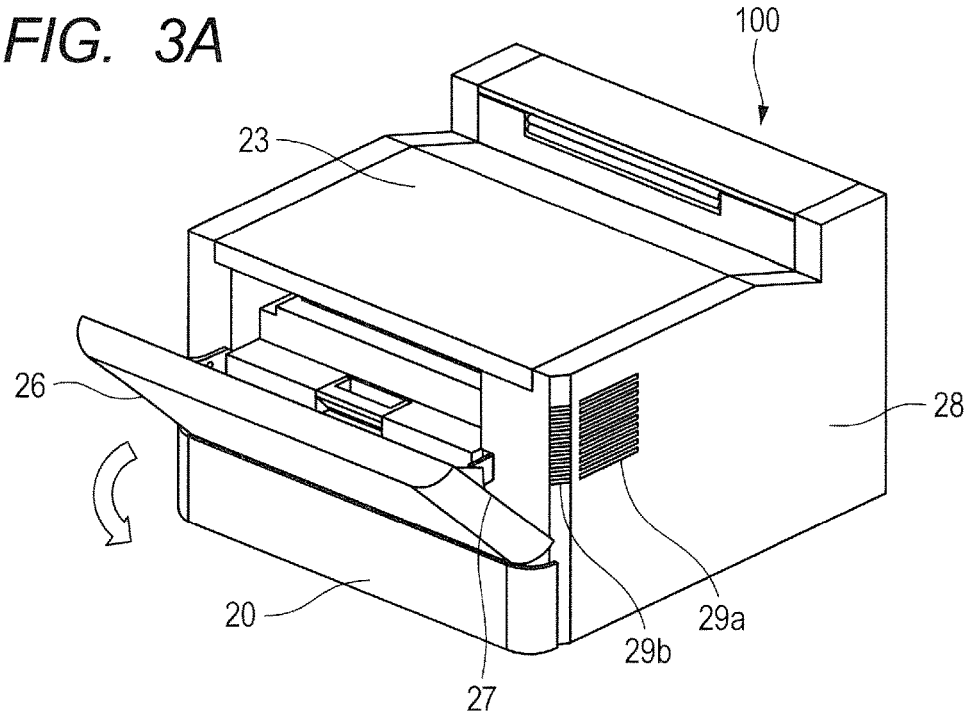
FIG. 3A and FIG. 3B are external perspective views showing how a process cartridge is changed.

To remove the process cartridges 1Y to 1K, as shown in FIG. 3A, first the front door 26 is turned by gripping a grip portion 27 of a front door 26 serving as an open/close cover (first cover). The front door 26 forms an outside surface of the image forming apparatus 100. Note that in the state shown in FIG. 1, the front door 26 is located at a predetermined position, covering an inside of the image forming apparatus 100.

Figure 3B:
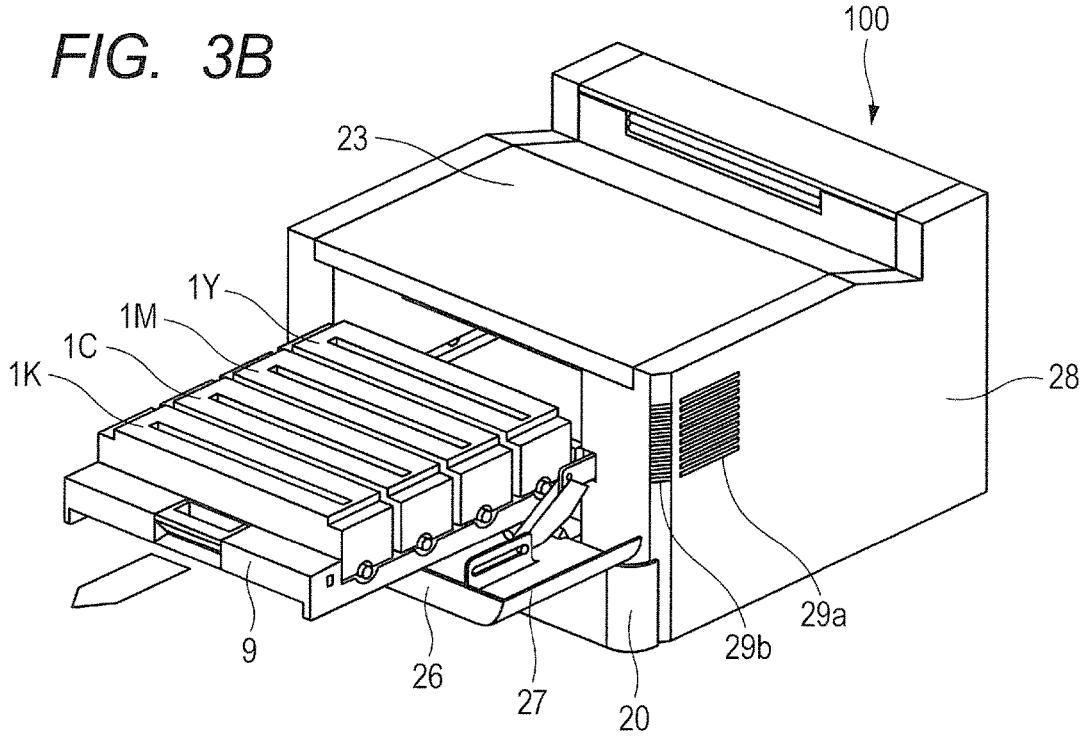

Then, with the front door 26 open, a tray 9 loaded with the process cartridges 1Y to 1K are pulled out from an opening in the direction of arrow as shown in FIG. 3B. This also applies when the process cartridges 1Y to 1K are mounted.

<Cooling Configuration in Image Forming Apparatus>

Figure 4:
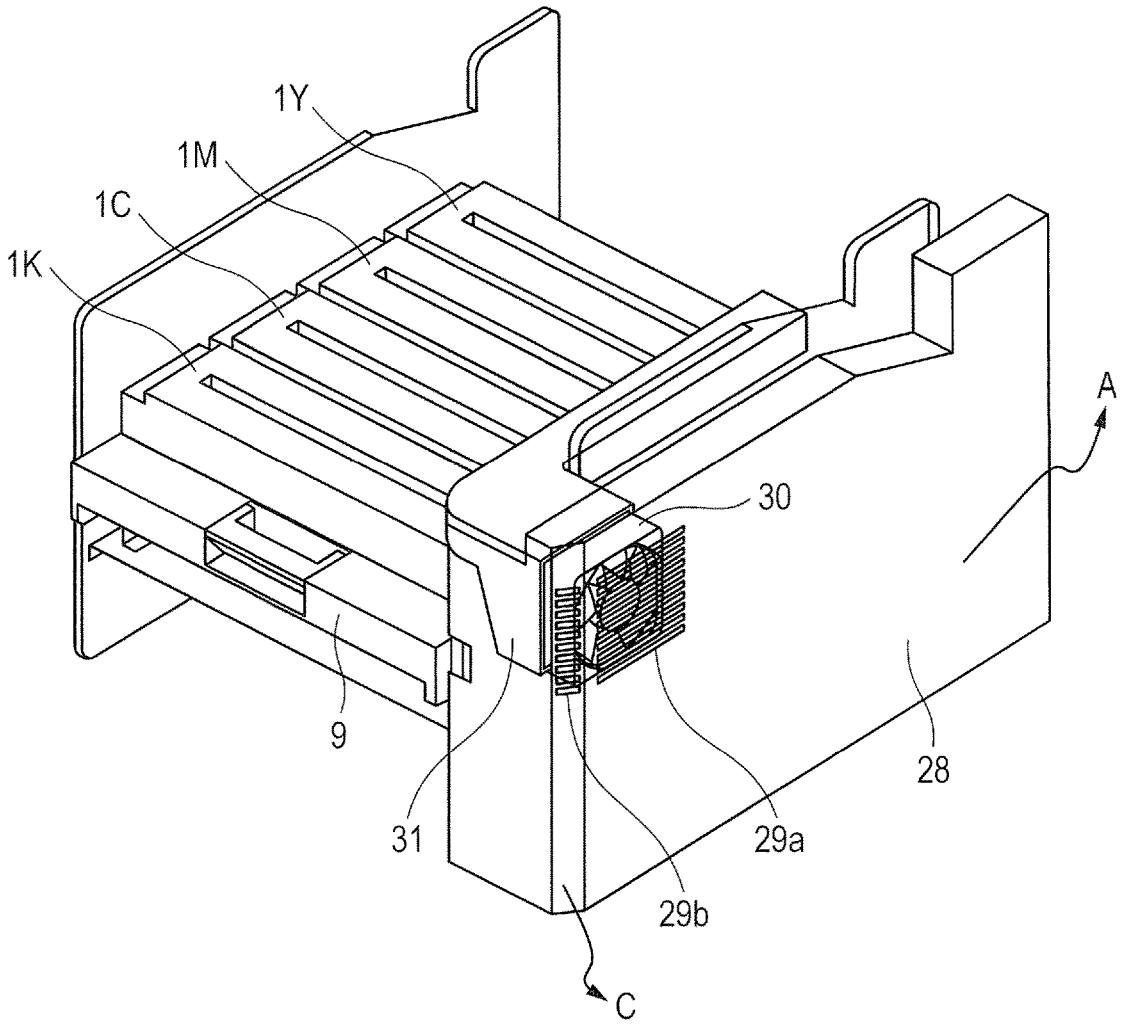
FIG. 4 is a perspective view showing an internal configuration of the image forming apparatus according to the embodiment.
Figure 5A:
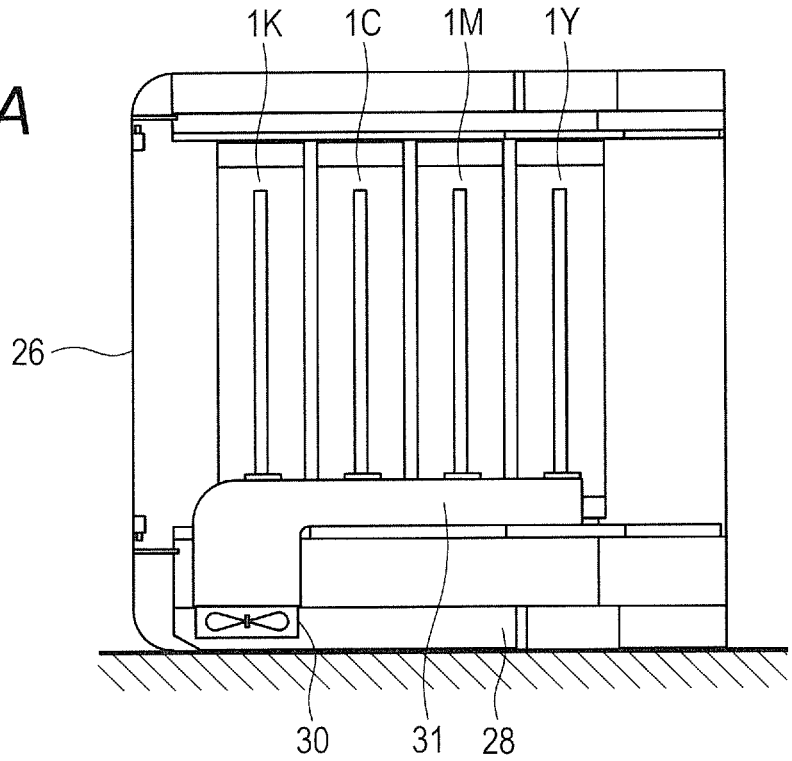
FIG. 5A and FIG. 5B are top views showing a flow of air flowing into the image forming apparatus.
Figure 5B:
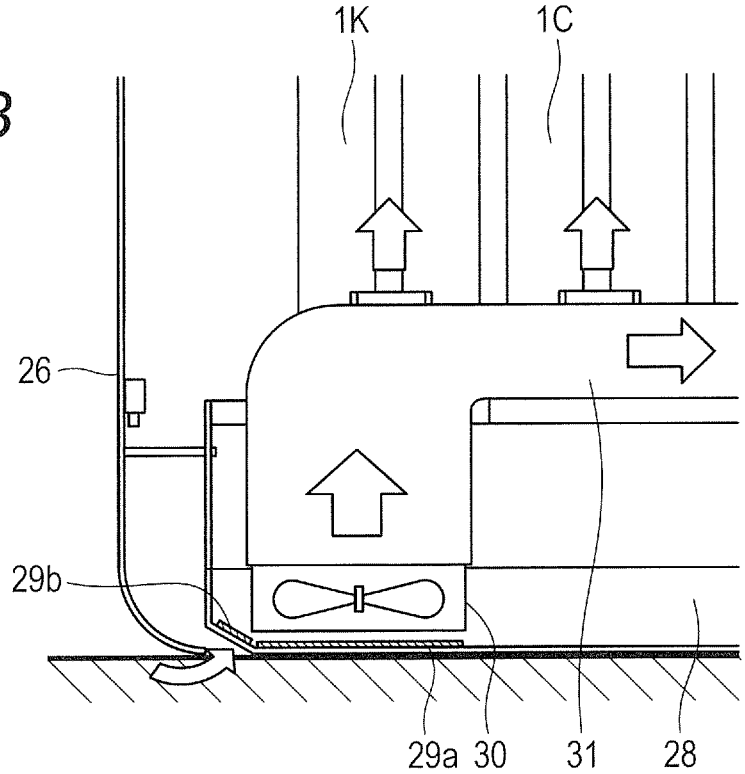

An internal configuration of image forming apparatus 100 will be described with reference to FIGS. 1, 4, 5A and 5B. FIG. 4 is a perspective view showing an internal configuration of the image forming apparatus 100 according to the embodiment. FIG. 5A and FIG. 5B are top views showing a flow (airflow) of air (ambient air) flowing into the image forming apparatus 100. As shown in FIG. 4, according to the present embodiment, air intake inlets 29*a* and 29*b* serving as vent holes are provided in a side cover 28, which is an enclosure of the apparatus body of the image forming apparatus 100, to cool the process cartridges 1Y to 1K. Here, the side cover 28 is a second cover making up a second outside surface A of the image forming apparatus 100 (see FIG. 1).

Also, an air intake fan 30 and duct 31 are provided inside the side cover 28. Of the side cover 28, the outside surface C (third outside surface) in which the air intake inlet 29*b* is provided is installed at an angle to the outside surface A (second outside surface) in which the air intake inlet 29*a* is provided (see FIG. 1). A first outside surface B constructed on the front door 26 (first cover) and a side face in which the air intake inlet 29*a* is provided are installed next to each other (see FIG. 1).

At least part of the outside surface C of the side cover 28 faces the front door 26 when the front door 26 is at a closed position (predetermined position).

Also, the air intake inlet 29*b* is provided on a curved surface linking the side face in which the front door 26 is provided and the side face in which the air intake inlet 29*a* is provided.

Note that it is not strictly necessary that two vent holes be provided in the side cover 28. It is enough that at least part of the vent hole is open, facing a space between the grip portion 27 and side cover 28. Also, according to the present embodiment, in a posture in which the image forming apparatus 100 is used normally, the side cover 28 covers the right and left side faces of the image forming apparatus 100. Note that the posture in which the image forming apparatus 100 is used normally means a posture assumed by the image forming apparatus 100 when a surface on which the paper output tray 23 is provided is a top surface in FIG. 2.

A concave portion is formed between the grip portion 27 of the front door 26 and the side cover 28. This makes it easy for a user to grip the grip portion 27 of the front door 26. According to the embodiment, when the front door 26 is closed, a space is formed between the side cover 28 and part of an edge portion of the front door 26, allowing the grip portion to be hooked by fingers. Note that according to the present embodiment, the side cover 28 includes a side face (second outside surface) in which an opening is provided and a side face (third outside surface) bent at a predetermined angle from the side face (second outside surface) via a corner portion. The space between the grip portion 27 of the front door 26 and the side cover 28 is formed between the corner portion and grip portion 27.

FIG. 5A is a diagram of an internal configuration of the image forming apparatus 100 as viewed from above. Also, FIG. 5B is an enlarged view of FIG. 5A. The air intake fan 30 is placed in a neighborhood of the air intake inlets 29*a* and 29*b* of the duct 31 and configured to send (take) air into the image forming apparatus 100 through the air intake inlet 29*a*. The air intake inlet 29*a* and air intake inlet 29*b* are placed next to each other. Consequently, airflow is produced inside the image forming apparatus 100. Also, an opening portion is provided in the duct 31 in a neighborhood of the process cartridges 1Y to 1K. As indicated by an arrow in FIG. 5B, the air drawn in by the air intake fan 30 through the air intake inlets 29*a* and 29*b* is released from an opening portion through the duct 31. That is, the duct 31 distributes the air sent into the image forming apparatus 100 by the air intake fan 30 to the process cartridges 1Y to 1K. Then, the air released from the opening portion flows from one end of the process cartridges 1Y to 1K toward the other end along a rotation center axis of the photosensitive drums 2*a* to 2*d*. In this way, surroundings of the process cartridges 1Y to 1K are cooled by causing air to flow around the process cartridges 1Y to 1K. That is, the process cartridges 1Y to 1K are cooled by the air sent into the image forming apparatus 100 by the air intake fan 30.

Here, according to the present embodiment, as shown in FIGS. 5A and 5B, even if an image formation operation is performed with the air intake inlet 29*a* closed, air flows into the image forming apparatus 100 through the air intake inlet 29*b*. Specifically, from above that surface of the side cover 28 in which the air intake inlet 29*b* is provided or through a gap between the front door 26 and side cover 28, air flows into the image forming apparatus 100 through the air intake inlet 29*b*. The air intake inlet 29*b* is provided at such a position that air will be sent into the image forming apparatus 100 through the air intake inlet 29*b* by the air intake fan 30. Then, the air sent into the image forming apparatus 100 through the air intake inlet 29*b* is guided toward the process cartridges 1Y to 1K by the duct 31. In this way, according to the present embodiment, even if the image forming apparatus 100 is placed in such a way as to block up the air intake inlet 29*a*, the surroundings of the process cartridges 1Y to 1K can be cooled by providing the air intake inlet 29*b*. Furthermore, in replacing the process cartridges 1Y to 1K, since the user opens and closes the front door 26 by gripping the grip portion 27, it is less likely that the image forming apparatus 100 will be placed in such a way as to block up the air intake inlet 29*a*.

Thus, according to the present embodiment, the air intake inlet 29*b* is provided in the side cover 28 at a position other than the side face in which the air intake inlet 29*a* is provided. This allows components in the image forming apparatus 100 to be cooled without increasing installation space of the image forming apparatus 100.

Figure 6:
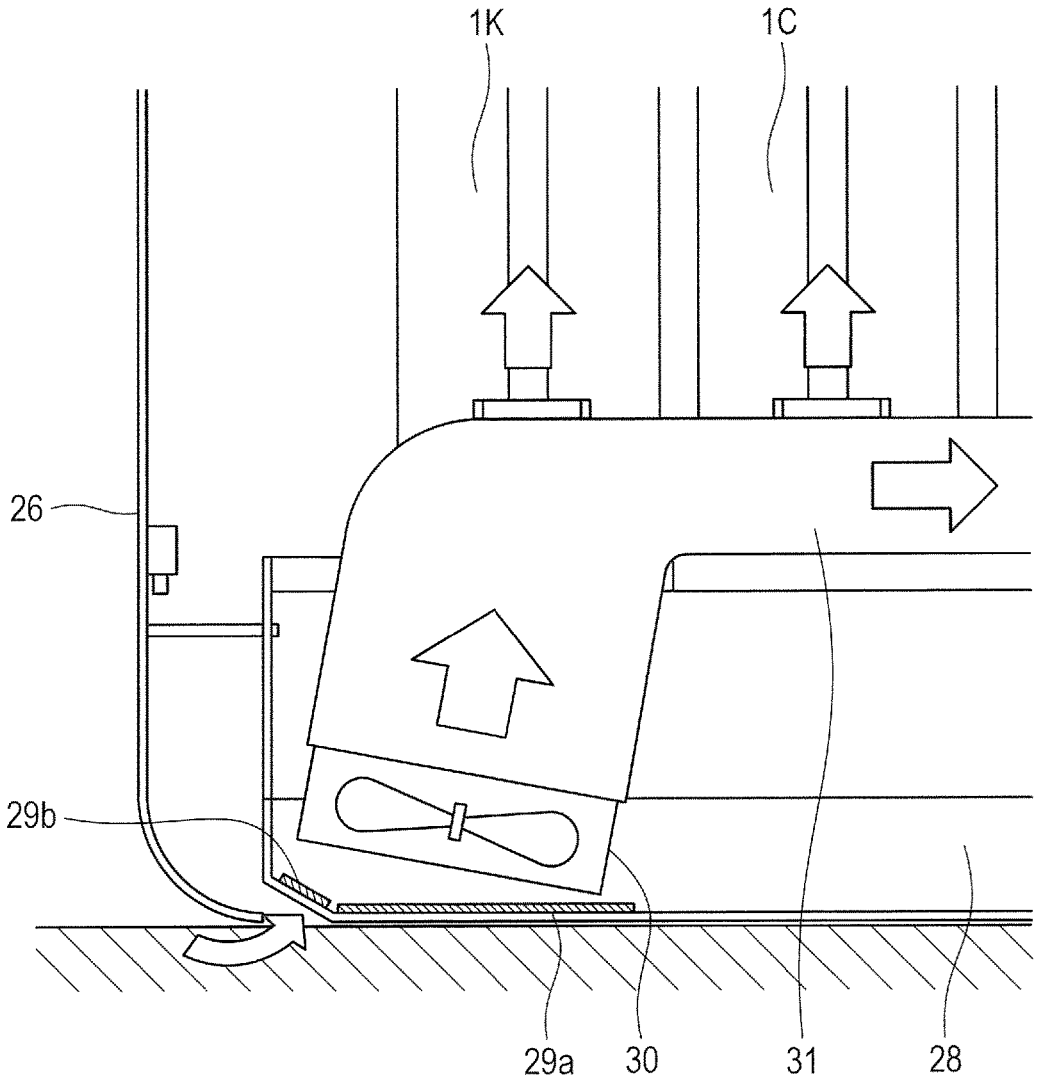
FIG. 6 is a top view showing placement of an air intake fan according to the embodiment.

Note that according to the present embodiment, the air intake fan 30 faces toward the air intake inlet 29*a*. That is, a rotating shaft of the air intake fan 30 is orthogonal to a side face of the image forming apparatus 100. However, as shown in FIG. 6, the air intake fan 30 may face both the air intake inlet 29*a* and air intake inlet 29*b*. In other words, the rotating shaft of the air intake fan 30 may be tilted toward the air intake inlet 29*b* (vent hole) from a direction orthogonal to the side face of the image forming apparatus 100. This makes it easy for air to enter through the air intake inlet 29*b*.

Figure 7:
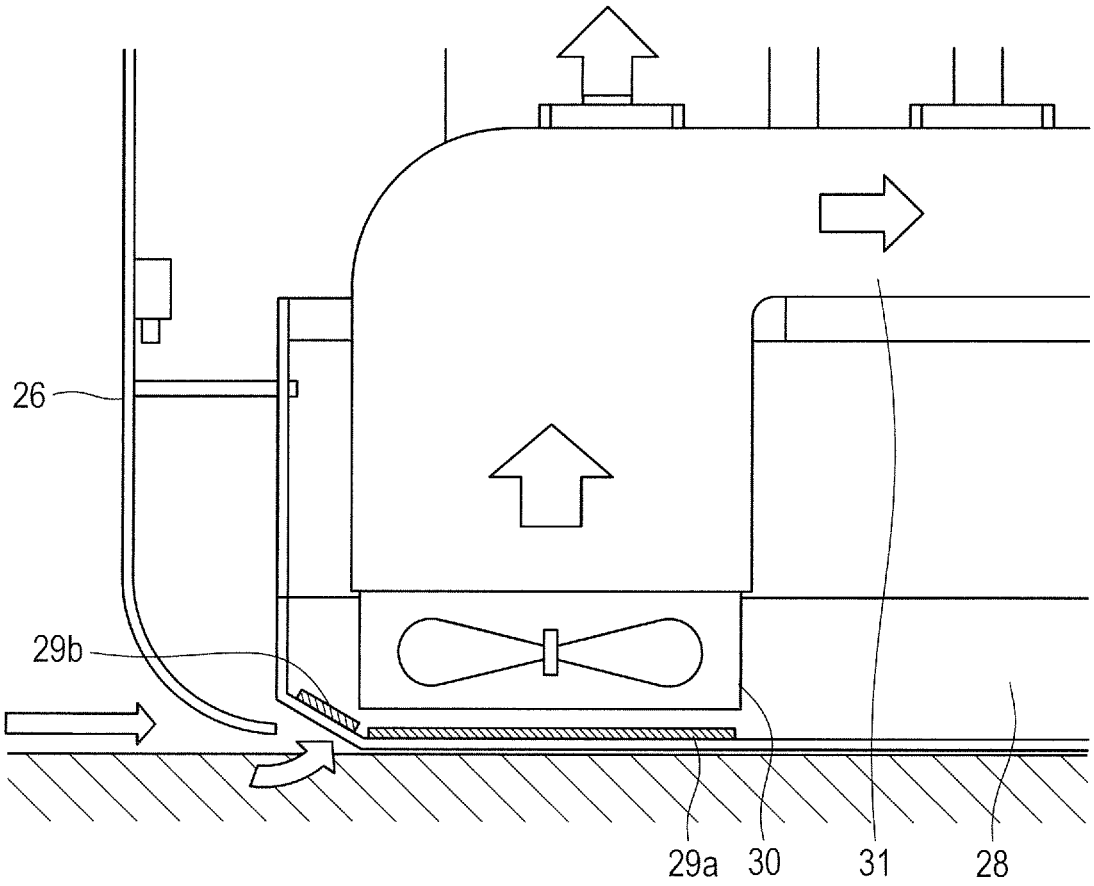
FIG. 7 is a top view showing a relationship between a front door and side cover according to the embodiment.

Also, according to the present embodiment, as shown in FIG. 7, in a substantially horizontal direction when the image forming apparatus 100 is placed in a normal manner, the side cover 28 may be smaller in width than the side face in which the front door 26 is provided. Consequently, even if the image forming apparatus 100 is installed in such a way that a wall will block up the air intake inlet 29*a*, air can flow into the air intake inlet 29*b* easily through a gap between the front door 26 and the wall.

Also, in the present embodiment, it is not strictly necessary to provide the front door 26 in the side face of the image forming apparatus 100. For example, the front door 26 may be provided in the top surface of the image forming apparatus 100. Also, in the present embodiment, it is not strictly necessary to provide the air intake inlet 29*b* in the side face of the image forming apparatus 100. For example, the air intake inlet 29*b* may be provided in the top surface of the image forming apparatus 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-239387, filed Dec. 8, 2015, which is hereby incorporated by reference herein in its entirety.

What is claimed is:

1. An image forming apparatus comprising:

a first cover configured to form a first outside surface of the image forming apparatus;

a second cover configured to form (i) a second outside surface of the image forming apparatus different from the first outside surface and (ii) a third surface which faces the first cover, the second cover including a first vent hole formed on the second outside surface, the second cover including a second vent hole formed on the third surface; and a fan provided inside the image forming apparatus, configured to take in ambient air through the vent first hole and the second vent hole, and generate airflow to cool an inside of the image forming apparatus, wherein the second outside surface is located to cross the third surface.

2. The apparatus according to claim 1, wherein the first cover is movable with respect to the second cover, and when the first cover moves from a predetermined position, the inside of the image forming apparatus is exposed.

3. The apparatus according to claim 2, wherein the second cover is a side cover of the image forming apparatus and the first cover is a front cover of the image forming apparatus.

4. The apparatus according to claim 3, wherein when the first cover is located at the predetermined position, a gripping portion used to grip the first cover is formed in an edge portion of the first cover.

5. The apparatus according to claim 4, wherein when the first cover is located at the predetermined position, the gripping portion faces the vent hole formed in the third surface.

6. The apparatus according to claim 5, wherein when the first cover is located at the predetermined position, the first cover and the second cover make up a corner portion of the image forming apparatus.

7. The apparatus according to claim 5, wherein the first cover is pivotable away from the third surface.

8. The apparatus according to claim 1, further comprising a process cartridge attachable to and detachable from the image forming apparatus, wherein the process cartridge is cooled by air entering the image forming apparatus through the vent hole.

9. An image forming apparatus comprising:

a main body covered by a housing member;

an opening/closing cover configured to open or close an opening portion provided on the housing member;

a vent hole provided on the housing member; and a fan provided inside the image forming apparatus, the fan configured to take in ambient air through the vent hole and generate airflow to cool an inside of the image forming apparatus, wherein the opening/closing cover has a gripping portion at an edge portion of the opening/closing cover so that a space is formed between the housing member and the gripping portion, and wherein at least part of the vent hole faces the space between the gripping portion of the opening/closing cover and the housing member.

10. The image forming apparatus according to claim 9, wherein the housing member includes a first surface on which the opening portion is provided and a second surface inclined with a certain angle with regard to the first surface through a corner portion connecting the second surface with the first surface, and the space formed between the housing member and the gripping portion is formed between the corner portion and the gripping portion.

11. The image forming apparatus according to claim 10, wherein the housing member has a front surface, a back surface provided on an opposite side of the front surface, and side surfaces connecting between the front surface and the back surface.

12. The image forming apparatus according to claim 10, wherein the vent hole includes a first vent hole provided on the second surface of the housing member, and a second vent hole provided on the corner portion.

13. The image forming apparatus according to claim 12, wherein the first vent hole is adjacent to the second vent hole.

14. The image forming apparatus according to claim 12, wherein a rotation axis of the fan is inclined toward a side of the second vent hole with regard to a direction perpendicular to the second surface.

15. The image forming apparatus according to claim 9, wherein a rotation axis of the fan is perpendicular to a side surface of the image forming apparatus.

16. The image forming apparatus according to claim 9, wherein air introduced into the image forming apparatus from the vent hole cools a process cartridge.

17. The image forming apparatus according to claim 9, comprising:

a plurality of process cartridges, each of which is configured to form a developer image formed on a recording medium, and a duct configured to distribute flows for each of the plurality of process cartridges.

18. The image forming apparatus according to claim 9, wherein the space allows the gripping portion to be hooked by fingers of a user.

* * * * *